United States Patent [19]

Marks

[11] Patent Number: 4,739,838

[45] Date of Patent: Apr. 26, 1988

[54] HAND-SQUEEZE POWERED MOTORLESS DRIVER

[75] Inventor: Joel S. Marks, Los Angeles, Calif.

[73] Assignee: Goldmar Manufacturing Co., Los Angeles, Calif.

[21] Appl. No.: 923,897

[22] Filed: Oct. 28, 1986

[51] Int. Cl.[4] ..... B25B 13/46

[52] U.S. Cl. ..... 173/170; 81/57.39; 74/89.15

[58] Field of Search ..... 173/18/170; 81/57.39, 81/57.29; 74/89.15, 424.8 B

[56] References Cited

U.S. PATENT DOCUMENTS

| | | | |
|---|---|---|---|
| 3,049,018 | 8/1962 | Lusskin et al. | 74/89.15 |
| 4,249,617 | 2/1981 | Cox, Jr. | 173/170 |
| 4,524,650 | 6/1985 | Marks | 173/170 X |

FOREIGN PATENT DOCUMENTS

| | | | |
|---|---|---|---|
| 850357 | 9/1970 | Canada | 81/57.39 |

*Primary Examiner*—Frank T. Yost
*Assistant Examiner*—James L. Wolfe
*Attorney, Agent, or Firm*—Keith D. Beecher

[57] ABSTRACT

A hand-squeeze driver tool which serves to convert squeezing motion into rotary motion on a variable torque basis, with the torque being inversely related to the driving speed. The torque versus driving speed relationship is determined by the position of a squeeze lever as it is displaced from its most extended position. Two distinct zones are provided as the squeeze lever is so displaced, namely a high torque low speed zone, and a low torque high speed zone. The provision of the high torque low speed initial zone, followed by the low torque high speed zone permits the operator intuitively to take advantage of the variable torque feature of the invention, which is provided by a traveling fulcrum mechanism incorporating two interacting levers. The tool of the invention may be constructed to receive standard format driver bits, permitting it to be used in a wide variety of different applications.

7 Claims, 5 Drawing Sheets

HAND-SQUEEZE POWERED MOTORLESS DRIVER

BACKGROUND OF THE INVENTION

The hand squeeze tool of the present invention is of the same general type disclosed in U.S. Pat. No. 4,524,650 which issued June 25, 1985 in the name of the present inventor.

The squeeze tool described in the Patent, like the squeeze tool of the present invention, serves to convert squeezing motion into rotary motion on a variable torque basis, and serves to transmit the rotary motion to a screw, bolt, or other fastener, which is being tightened or loosened. The tool described in the Patent incorporates a pull lever and a varying force transmitting lever which operate in conjunction with a squeeze handle to provide a traveling fulcrum, so that when the squeeze handle is squeezed maximum torque and minimum speed are generated at the beginning of the stroke, and maximum speed and minimum torque are realized for the remainder of the stroke.

As described in the Patent, the principal objective of the squeeze tool is to overcome limitations inherent in prior art tools, such as ratchet wrenches. These limitations occur because the prior art ratchet wrenches exert a uniform torque on the bolt being turned, and, accordingly, when such a ratchet wrench is designed to exert sufficient torque initially to loosen a bolt, that torque continues when the bolt is being loosened and when it is not needed. This means that the prior art ratchet wrenches must be designed to incorporate more handle motion than is actually required for a particular operation, this is especially troublesome when space and/or accessibility are limited. Unlike the prior art ratchet wrench, the tool described in the Patent, as well as the tool of the present invention, automatically match the available torque with the torque required for a particular operation, and this is achieved by varying the torque. The net result is that a particular operation may be performed with maximum speed and yet with a generation of the required torque.

The tool of the present invention, like the tool described in the Patent, is intended to provide a capability which has been unavailable with the prior art manual, spiral ratchet, or motorized drivers, as mentioned briefly above. Manual drivers provide accurate control of a driving operation, but they are limited in speed to that at which the operator can rotate the tool. In addition, the wrist twisting motion required by a manual driver can become unnecessarily tiresome when used for light to medium duty applications. Spiral ratchet drivers provide poor control over the axial force applied to a driven element, since the turning torque is entirely dependent upon this axial force. As a result, spiral ratchet drivers are especially limited in their ability to remove threaded fasteners, and have limited power when the operator cannot place his body directly behind the axis of the force application.

Motorized drivers provide poor control of the rotation speed and torque applied to the driven element. The operator controls a switch, which in turn controls a motor, which finally powers the driven element. The user, accordingly, has little direct control over the events occurring at the driven element. In many instances, this lack of "feel" by the operator causes damage to the driven element and/or to its surroundings, especially in medium and light duty applications. The addition of a torque-limiting clutch in such a motorized tool is only a partial solution to the problem since it cannot account for the variables encountered in non-production type operations. Finally, the motorized tool is confined during use or storage by the need to be attached to a power supply line or battery charger.

Unlike the prior art tools described in the preceding paragraphs, the driver tool described in the Patent and the driver tool of the present invention allow for relatively high speed driving, while the operator maintains direct control over the axial force, torque, and turning rate applied to the driven element. The operator's hand is limited both in ultimate squeezing force and total possible squeezing motion. Therefore, to use the power created in the squeeze of the hand efficiently, the mechanism of the tool described in the Patent, and the tool of the present invention, allow the operator to amplify either his squeezing force or his squeezing motion. Through the action of further components within the driver, this variable force amplification is translated into a variable torque upon an output shaft. In this manner, the tool described in the Patent and the tool of the invention can accommodate a wide range of different driving conditions, constrained only by the total power available through the operator's hand.

A unique feature of the hand-powered variable torque drive tool of the present invention is that it provides two distinct operating zones as the operating handle is squeezed, so that during the initial portion of the squeeze stroke the torque generated by the drive shaft is a maximum and the rotational velocity of the drive shaft is a minimum, whereas during the latter part of the squeeze stroke the torque is a minimum and the velocity is a maximum. This enables the operator intuitively to take advantage of the variable torque feature of the invention, since the provision of a high torque region and a low torque region allows the operator to anticipate what torque magnification will occur as the control handle is squeezed. This is advantageous over a continuously varying torque where the torque capability of the tool as the operating handle is squeezed is less predictable.

The tool of the invention may be used to remove or install threaded fasteners, such as screws. It finds particular utility when a fastener requires light-to-medium turning torques for the major part of its travel in and out of a receiving hole, with maximum torque requirements occurring only during the initial loosening or final tightening of the fastener. The operator uses the high torque zone of the squeeze stroke only for initial loosening or final tightening of the fastener; and the rest of the driving operation is accomplished using the low torque high speed zone of the squeeze stroke, where a minimum of hand motion is required. Through use of the tool of the invention the foregoing operations become intuitive.

The tool of the present invention is also simpler and less complex than the tool described in the Patent, it may be manufactured more efficiently and on a more economical basis, and it includes innovations which make it more functional.

The tool of the invention is constructed for convenient and comfortable one-handed operation through the shape and contour of its handles. It may be used as a conventional ratchet driver in which the operator rotates the entire body of the tool back and forth about its driving axis to produce a net rotation of the driving tip, and when used in this manner, prolonged high torque driving may be accomplished.

When using the tool of the invention, the operator's hands are not in the region of the driving axis as they must be when using a conventional screwdriver, and fasteners may therefore be driven in corners, where the driving axis often closely parallels a wall or other obstruction, when the tool of the invention is used.

Standard one-fourth inch hexagonal shaft driver bits may be used with the tool of the invention, providing the largest possible variety of available bits and accessories. Because the tool requires no motor or batteries, it is light weight, which facilitates its use and storage.

The tool of the invention finds utility in various applications, including the removal and installation of panels and fixtures in automobiles, electronic and telecommunication apparatus, aircraft, spacecraft, industrial equipment, cabinets and doors. Moreover, the tool of the invention may conveniently be used in the disassembly or re-assembly of furniture, in the installation of plumbing hose clamps, and for general household use.

It is, accordingly, an objective of the present invention to provide an improved hand-squeeze driver tool for use with screw-type fasteners, and which exhibits a first distinct high torque, low speed zone as its operating handle is squeezed, for precise control and for tightening or loosening the fastener; followed by a second distinct low torque, high speed zone for driving the fastener. Selection of the zones is performed intuitively and instantaneously, requiring only that the operator squeeze the operating handle between the appropriate positions.

The driver tool of the invention provides an intimate control of the driving operations, since it is hand powered rather than motor powered, and this minimizes the occurrence of damage to fasteners and/or assemblies in which they are used. The tool of the invention is entirely portable, both in use and in storage, since it requires no power supply line or batteries. The tool is particularly advantageous, as mentioned above, in that it may be inexpensively produced by conventional mass production means. Moreover, it has a pleasing overall configuration and appearance.

DETAILED DESCRIPTION OF THE ILLUSTRATED EMBODIMENT

Figure 3:
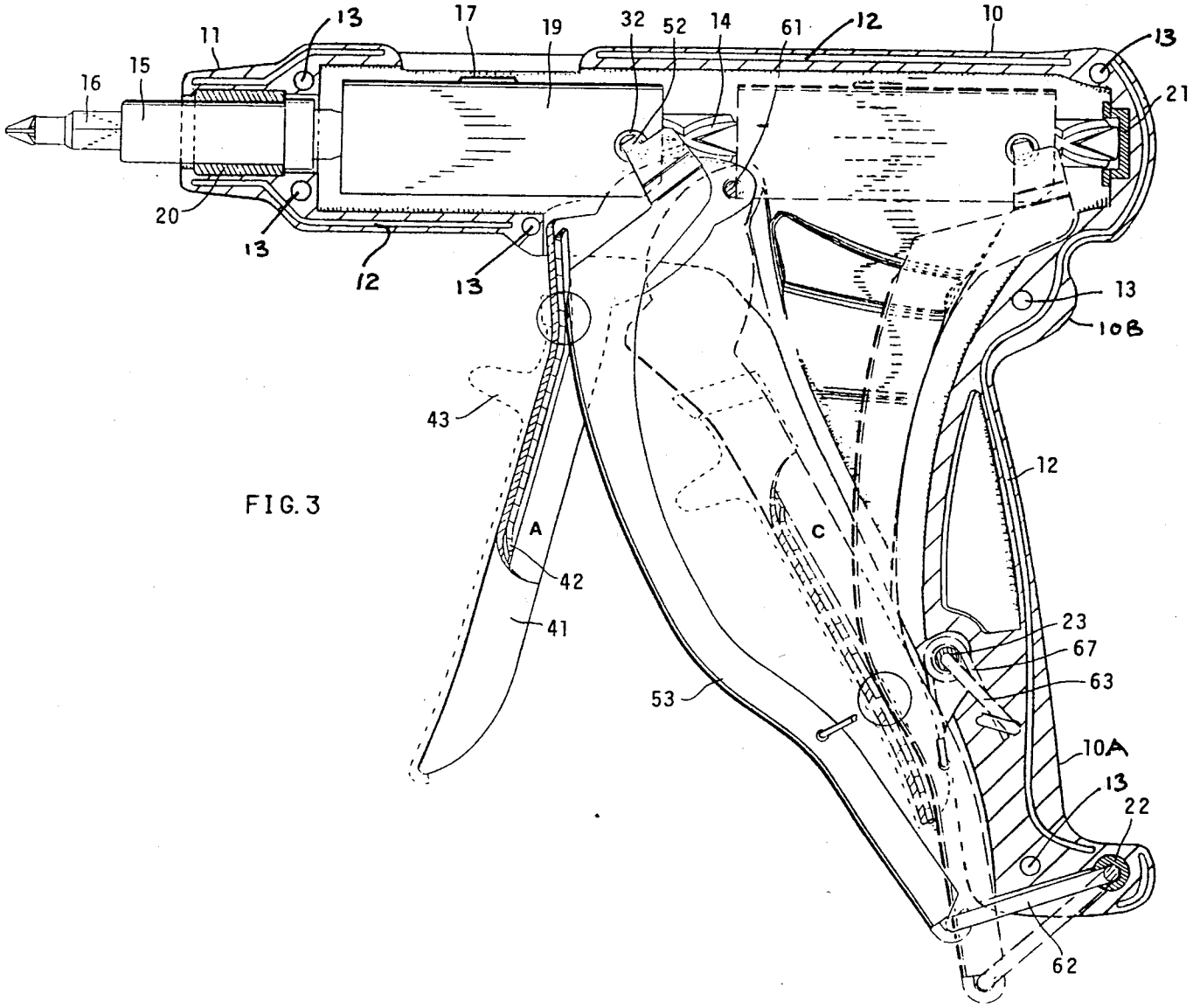
FIG. 3 is a side elevation of the tool of FIG. 1 with one side of the housing removed to reveal the internal components of the tool.

The driver tool of the invention includes a two-part molded plastic housing 10, of which one-half has been removed in FIG. 3. The two halves of the housing 10 are positioned relative to one another by tongue-and-grooves 12, and are joined together by screws received in holes 13. The assembled housing includes an octagonal forward section 11 which may be inserted into accessories to prevent them from rotating relative to the housing.

A double spiral-cut torque transmitting shaft 14 (FIG. 3) is attached to a bit retaining tip 15. The tip and shaft assembly is rotatably mounted in a front bearing 20 and in a rear bearing 21. The forward end of tip 15 is hollow to form a cavity which receives a screwdriver bit 16. The tip cavity and bit each has a hexagonal cross-section. This standard format permits the tip to receive a wide variety of standard bits. The tip cavity contains a spring which serves to hold the bit 16 in place by frictional engagement.

A slider 19, which may be similar to the operating mechanism of a conventional spiral ratchet screwdriver, is mounted on shaft 14 for movement along the length of the shaft. The slider 19 is moved along the shaft by the action of a squeeze lever 41, as will be explained, and the slider is so moved from a first position on shaft 14 corresponding to the squeeze lever 41 in position A (FIGS. 2 and 3), to a second position on the shaft corresponding to the squeeze lever in position C.

Figure 4:
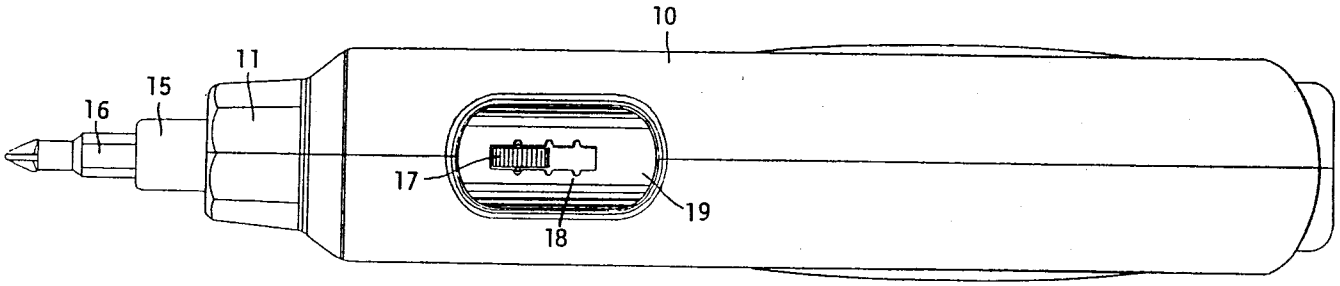
FIG. 4 is a top view of the tool of FIG. 1, showing a direction controller for the screwdriver bit.
Figure 5:
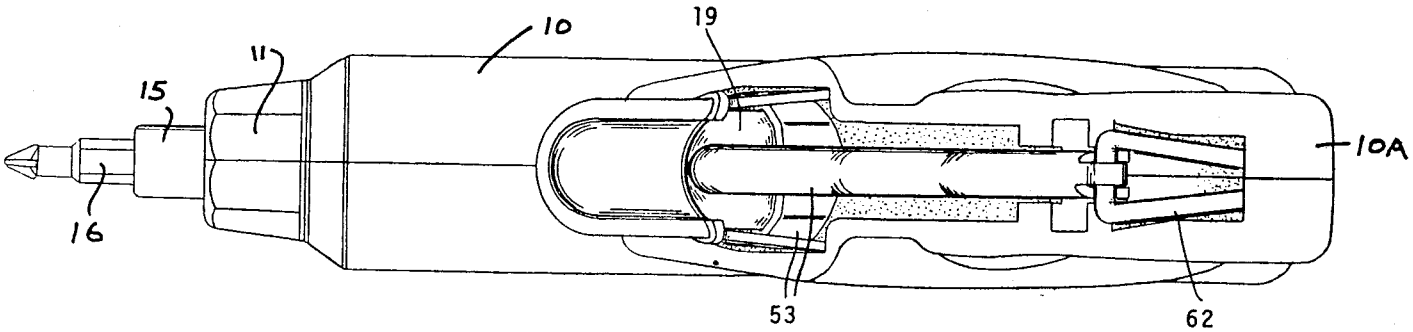
FIG. 5 is a bottom view of the tool of FIG. 1.

A conventional directional controller 17 (FIGS. 3 and 4) is provided on slider 19 to cause shaft 14 to turn in one direction or the other when the slider is drawn along the shaft from its first to its second position towards the rear end of housing 10. Spiral shaft 14 has two parallel helical grooves cut in each direction for a total of four helical grooves, as typically contained in the conventional spiral ratchet screwdriver.

A return spring assembly including a spring 67 (FIGS. 1, 3, 6, 7 and 8) is provided to return the slider to its first position and to return squeeze lever 41 to position A.

Squeeze lever 41 may be formed from sheet steel. The squeeze lever is fitted with a molded vinyl cover 43 over its side and forward exterior surfaces, and with a low friction material 42 along its forward interior surface. The squeeze lever is pivotally coupled to housing 10 at its upper end by a pin 61. A curved lever 53 is pivotally connected at its upper end to slider 19, and at its lower end to a pivot member 62 of a shape shown in FIG. 9. Lever 53 is also connected to return spring 67. Lever 53 may also be formed of sheet steel.

Squeeze lever 41, curved lever 53, and the lower pivot member 62 act together to provide a variable force on slider 19 by the creation of a traveling fulcrum, which will be described. This variable force is in turn converted into a variable torque by the conventional action of slider 19 on shaft 14. The fulcrum is the tangency or contact point between squeeze lever 41 and curved lever 53, which is encircled in FIG. 3 for position A and for position C.

The torque profile describes the position of the tangency point, or fulcrum, between levers 41 and 53 as a function of the position of squeeze lever 41. The torque profile is determined by the position and radii of the bends in levers 41 and 53. In the illustrated embodiment, two relatively large sharp bends are present in the contact region of the two levers, one being towards the upper end of lever 41 and the other being at the lower center of lever 53. These bends are present at the encircled tangency points shown in FIG. 3 for lever positions A and C. Between the illustrated contact regions, the levers have a relatively large contact radii which, in the case of squeeze lever 41, is infinite.

Figure 1:
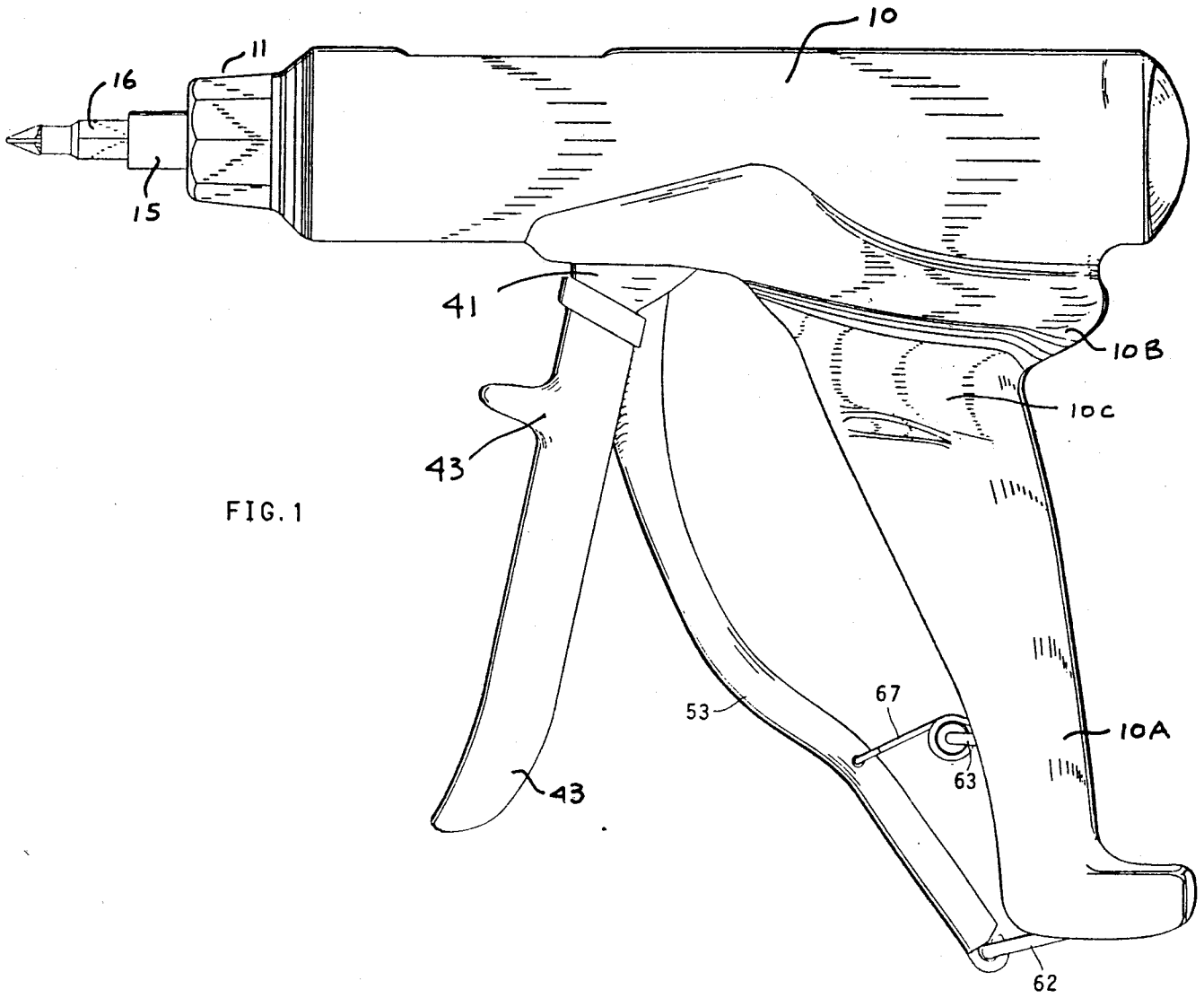
FIG. 1 is a side elevation of the squeeze driver tool of the present invention in one of its embodiments, with a screwdriver bit mounted at one end of the tool, and with the squeeze lever and other components of the tool in their extended positions.
Figure 2:
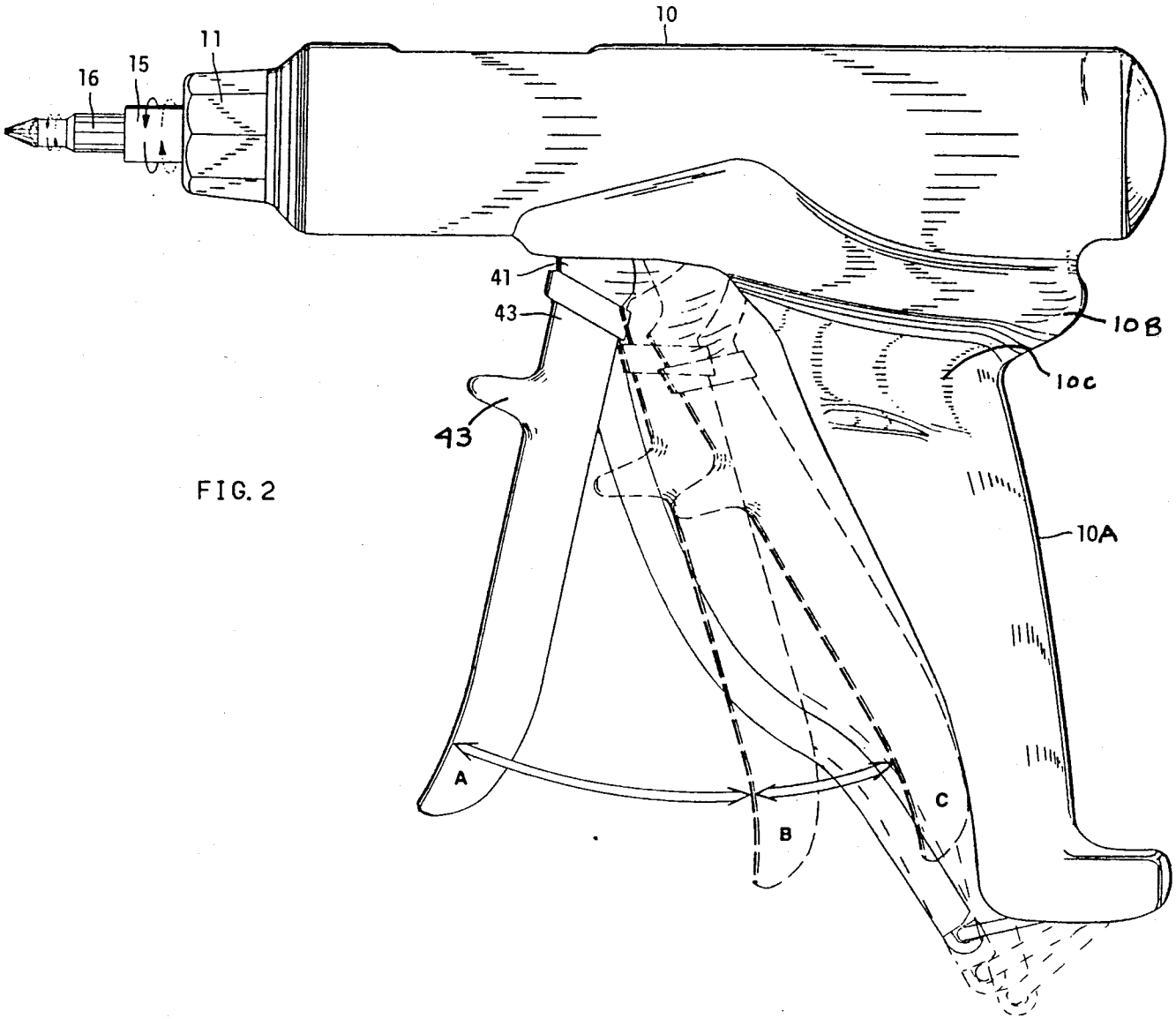
FIG. 2 is a side elevation of the squeeze driver tool of FIG. 1, with the squeeze lever shown (a) in its extended position, (b) in an intermediate position, and (c) in its retracted position.

The result of the geometry described above is that contact between levers 41 and 53 occurs in the upper region for positions A through B of the squeeze lever 41 in FIG. 2 to provide the distinct high torque low speed zone; while contact between the levers occurs in the lower region for positions B through C of the squeeze lever 41 to provide the distinct low torque high speed zone. The contact point, or fulcrum, travels between these two regions in the vicinity of position B of the squeeze lever 41. Squeeze lever 41 has a maximum leverage during the first zone between positions A and B of the squeeze lever when the fulcrum point is in the upper region, and the squeeze lever has minimum leverage during the second zone between positions B and C of the squeeze lever when the fulcrum point is in the lower region. In any of these positions of the squeeze lever, this leverage is translated into an axial force with respect to shaft 14 at the top of curved lever 53.

Between positions A and B of squeeze lever 41, where the combined action of the squeeze lever and curved lever 53 provide the maximum axial force to slider 19, the motion imparted to the slider is relatively minor. The major portion of the travel of the slider 19 along shaft 14 occurs between positions B and C of the squeeze lever. The general movement of squeeze lever 14 is greater than that of slider 19 for positions A through B while the converse is true for positions B through C.

In practice, the two distinct different leverage zones translate into two torque regions. The torque available at tip 15 is maximum and rotational speed of the tip is a minimum between positions A and B of squeeze lever 41, while the torque is a minimum and rotational speed of tip 15 is a maximum for positions B through C of the squeeze lever, for a particular force and angular velocity of the squeeze lever.

Figure 9:
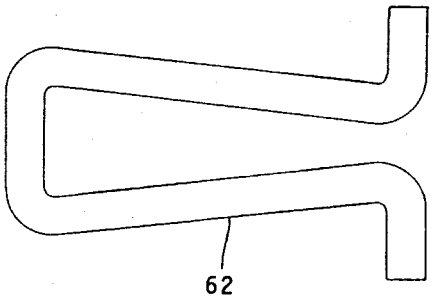
FIG. 9 is a top view of a pivot member which is included in the tool.

The rear end of pivot arm 62 rotates within bushings 22 in the handle portion of body 10, and the forward end of the pivot arm rotates within a bent tab at the lower end of curved lever 53. The actual configuration of pivot arm 62 is shown in FIG. 9. The upper end of curved lever 53 has inwardly facing tabs 52 (FIG. 3) which rotate within bushing 32 mounted in either side of slider 19.

The location of pin 61 relative to squeeze lever 41 is such that the squeeze lever engages curved lever 53 by a sliding and rolling contact between squeeze lever positions A and B illustrated in FIG. 2. However, between positions B and C, the two levers engage one another by a largely rolling contact, with minimal sliding.

To prevent excessive friction as slider 19 is drawn in the rearward direction along shaft 14 to cause the shaft to rotate, the forces imparted upon the slider by curved lever 53 are essentially axial to the shaft, with minimal upward or downward components. The length and relative position of pivot arm 62 and return spring assembly 23, 63 and 67, are such that the action of these components upon curved lever 53 counteract the non-axial forces imparted to the curved lever by squeeze lever 41. The single bend at the upper end of squeeze lever 41 also serves to minimize non-axial forces. This cancellation of non-axial forces occurs for virtually any position of and force exerted upon lever 41, where the non-axial forces consist of an upward or downward force on slider 19.

The performance of the return spring assembly 23, 63 and 67 has significant effect upon the usefulness of the tool of the invention. When properly designed, the return spring assembly functions with other components of the tool to prevent friction through the cancellation of the non-axial forces, as explained above. In addition, the return spring assembly is constructed to provide a maximum return bias when it is extended in position A of the squeeze lever, while this return bias decreases or remains constant as the squeeze lever is moved towards position C.

Figure 6:
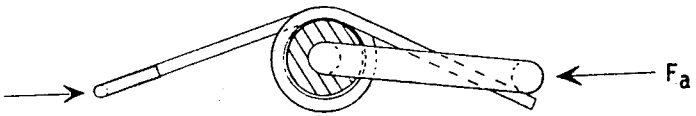
FIG. 6 is a side elevation of a return spring assembly which is included in the tool, the assembly being shown in its extended position.
Figure 7:
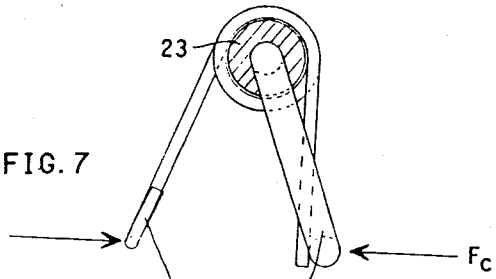
FIG. 7 is a side elevation of the return spring assembly of FIG. 6, shown in its contracted position.
Figure 8:
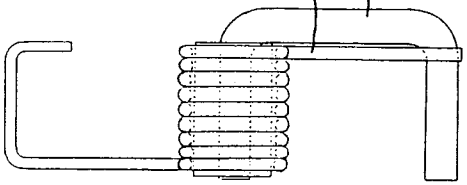
FIG. 8 is a top view of the return spring assembly of FIG. 6 shown in its extended position.

As shown in FIGS. 6 and 7, F(a) is greater than or at least equal to F(c) in the illustrated assembly. This is achieved by the torsion spring configuration of the return spring 67. When minimum torque is present at tip 15, the force required to contract squeeze lever 41 from position A to position C is essentially constant even as the lever arm available through lever 53 to return bias lever 41 varies. In practice, such an assembly allows a reliable return to the fully extended position, while excessive force is not required to achieve the retracted position, in which the ability of squeeze lever 41 to counteract the return spring action is at its lowest.

To operate the illustrated embodiment of the invention, the operator normally grasps the downwardly extending grip handle portion 10A of body 10, such that his thumb rests horizontally in the concave region 10C at the upper end of the grip handle. His hand then wraps around the grip handle with his fingers around the squeeze lever 41. The index finger rests above the forward facing protrusion in vinyl cover 43 of the squeeze lever, while the remaining fingers are positioned below the protrusion. With the hand so positioned, the weight of the tool is comfortably supported by the flange 10B at the upper portion of the grip handle while the forward and backward tilt of the tool is controlled by the fingers positioned about the protrusion in vinyl cover 43.

As squeeze lever 41 is squeezed, it is drawn toward the grip handle 10A, and the movement of the squeeze lever is transmitted through the curved lever 53 to slider 19, against the force of return spring 67 and against the rotating load on tip 15. The return spring biases the curved lever 53 towards its extended position allowing the curved lever to act upon squeeze lever 41 and slider 19 to return these to the extended position, shown by position A in FIGS. 2 and 3. As slider 19 is pulled toward the rear of the torque transmitting shaft 14, the shaft is caused to rotate in one direction or the other, depending upon the setting of direction controller 17. Slider 19 returns to its original position without any rotation of shaft 14 when squeeze lever 41 is released, because of the action of the conventional internal components of slider 19.

The two distinct fulcrum regions, as encircled in FIG. 3 and as explained above, are provided to facilitate control during operation of the tool. The operator typically uses positions A through B of squeeze lever 41, which correspond to the upper fulcrum region and hence to the high torque/low driving speed zone of the squeeze stroke, for loosening or tightening threaded fasteners. He then uses positions B through C of squeeze lever 41, which correspond to the lower fulcrum region and hence to the low torque/high speed zone of the squeeze stroke, for driving the fastener once it has been loosened or until it is tightened.

Limiting the torque profile to two distinct basic zones, namely, the high torque low speed zone and the low torque high speed zone, permits the operator to anticipate what force, or torque, magnification will occur as squeeze lever 41 is squeezed. A continuously varying torque profile, which would be provided by eliminating the sharp bends in levers 41 and 53, would cause the change in torque capability to be less predictable as lever 41 is squeezed, and hence would cause the tool to be less useful.

The invention provides, therefore, a driving tool which is typically used rotatably to drive threaded fasteners into and out of appropriate receiving holes. The tool of the invention is fully portable, both in storage and in use, since it requires no electrical or power source other than the operator's own hand. Moreover, when used for light-to-medium duty applications, the tool provides driving speeds comparable with many motorized drivers, while enabling precise control of the fastener or other driven device. Such precise control is possible with the tool of the invention through "torque feedback", wherein by a reaction to his squeezing effort, the operator instantly feels the effect of the torque being supplied to the driven fastener. Moreover, to accommodate the limited force and travel available in the squeeze of a hand, the tool of the invention is constructed to amplify within its internal components, either the force of the squeeze or the speed of the squeezing motion, through a varying lever arm mechanism.

The illustrated embodiment of the invention has been optimized conceptually and empirically, and it is intended to be asthetically pleasing and to provide efficient operation during actual use, while at the same time representing a simple design specifically intended for large-scale production using common mass production techniques.

It should be pointed out that while a particular embodiment of the invention has been shown and described, modifications may be made, and it is intended in the claims to cover all such modifications which come within the true spirit and scope of the invention.

I claim:

1. A hand-powered variable torque driver tool comprising: a body having a tubular section and an outwardly-extending grip handle section; an elongated squeeze lever pivotally coupled at one end to said tubular section of said body and extending outwardly from said body in essentially spaced and parallel relationship with said grip handle section; a helically-channeled drive shaft rotatably mounted in said tubular section of said body in coaxial relationship therewith; a drive member coaxially mounted at one end of said drive shaft and extending through an opening at one end of said tubular section of said body; a slider mounted on said drive shaft to produce rotational motion of said drive shaft and of said drive member as said slider is moved in a particular direction along said drive shaft; and an elongated curved lever pivotally coupled at one end to a selected pivot point on said slider and positioned to be directly engaged by said squeeze lever upon pivotal movement of said squeeze lever towards said grip handle to provide a relatively high torque and low rotational velocity to said shaft during pivotal movement of said squeeze lever through an initial range and to provide relatively low torque and high velocity to said drive shaft during pivotal movement of said squeeze lever through a final range; said squeeze lever and said curved lever being shaped to define a fulcrum point between said levers which travels between a first contact position located a predetermined distance from said selected pivot point on said slider through an initial range of movement of said squeeze lever, and a second contact position displaced from said pivot point on said slider a greater distance than said first contact position through said final range of movement of said squeeze lever, said curved lever having maximum leverage at said pivot point on said slider through said initial range of movement of said squeeze lever when the fulcrum point is at said first contact position, and said curved lever having minimum leverage through said final range of movement of said squeeze lever when the fulcrum point is at said second contact position, said squeeze lever and said curved lever having relatively sharp bends in the vicinity of said first and second contact positions so that said contact positions occur primarily in two distinct regions along said squeeze and curved levers as a result of the particular location and radii of said bends; and a pivot member pivotally coupling the other end of said curved lever to the end of said grip handle section so that the force applied to said curved lever by said squeeze lever is transmitted to said slider with a magnitude that is a function of the distance between the fulcrum point and said other end of said curved lever.

2. The hand-powered variable torque driver tool defined in claim 1, in which said squeeze lever and said curved lever have relatively sharp bends in the vicinity of said first and second contact positions so that said contact positions occur primarily in two distinct regions along said squeeze and curved levers as a result of the particular location and radii of said bends.

3. The variable torque driver tool defined in claim 2, and which includes a pivot member pivotally coupling the distal end of said curved lever to the distal end of said grip handle section so that the force applied to said curved lever by said squeeze lever is transmitted to said slider with a magnitude which is a function of the distance between the fulcrum point and the distal end of said curved lever.

4. The hand-powered variable torque driver tool defined in claim 1, and which includes a return spring assembly including a torsion spring attached to said curved lever and to said grip handle section adjacent to the distal ends thereof to provide maximum bias force when said curved lever is displaced from said handle section at its maximum angular displacement, and to provide decreased bias forces for other angular displacements of said curved lever.

5. The hand-powered variable torque driver tool defined in claim 4, in which said pivot point is selected and said curved lever is configured so that the force applied to said slider by said curved lever occurs essentially coaxially to said drive shaft for all positions of said slider, the non-coaxial forces imparted to said curved lever by said squeeze lever being counteracted by equal and opposite non-coaxial forces imparted to said curved lever by said pivot member and said return spring assembly both in the presence and in the absence of a torsion load on said drive shaft.

6. The hand-powered variable torque driver tool defined in claim 1, in which said drive member is configured to accept standard hexagonal driver bits.

7. A hand-powered variable torque driver comprising: a body; a drive shaft rotatably mounted in said body; a slider movable along said drive shaft to produce rotational motion of said drive shaft; and a drive mechanism for said slider comprising first and second levers respectively pivotally coupled to said body and to said slider at their upper ends, and said second lever being pivotally coupled to said body at its lower end, and said levers being positioned to contact one another as said first lever is pivotally displaced about its pivot point at a contact point which moves from one fulcrum position to another to vary the effective lever arm of said second lever as a function of the angular displacement of said first lever, and said levers being shaped to establish a first fulcrum position for an initial displacement range of said first lever and a second fulcrum position for a final displacement range of said first lever, said second lever having maximum leverage on said slider through the initial displacement range of said first lever at said first fulcrum position, and said second lever having minimum leverage on said slider during the final displacement range of said first lever at said second fulcrum position, at least one of said first and second levers having relatively sharp bends in the vicinity of the first and second fulcrum positions so that the fulcrum positions occur primarily in two distinct regions along said first and second levers as a result of the particular location and radii of said bends.

* * * * *